United States Patent [19]

Rubin

[11] Patent Number: 4,698,042

[45] Date of Patent: Oct. 6, 1987

[54] STORAGE BOX FOR BOAT

[76] Inventor: Jim Rubin, Box 907, Weyburn, Saskatchewan, Canada, S4H 2L2

[21] Appl. No.: 896,819

[22] Filed: Aug. 15, 1986

[51] Int. Cl.[4] ..... A63H 23/00

[52] U.S. Cl. ..... 446/75; 446/71; 446/160

[58] Field of Search ..... 446/75, 71, 77, 160; 312/229, 206, 108; 248/205.8

[56] References Cited

U.S. PATENT DOCUMENTS

| | | | |
|---|---|---|---|
| 10,114 | 5/1882 | Reed | 446/75 |
| 741,903 | 10/1903 | Gates | 446/71 |
| 1,213,046 | 1/1917 | Welch | 446/160 |
| 1,566,860 | 12/1925 | Hainzigianis | 312/206 |
| 1,639,707 | 8/1927 | Shaver | 446/160 |
| 2,530,317 | 11/1950 | Storey | 446/160 |
| 3,228,736 | 1/1966 | Beckerman | 312/108 |
| 3,696,914 | 10/1972 | McPhail | 446/71 |
| 3,756,681 | 9/1973 | Croston | 312/229 |
| 4,106,657 | 8/1978 | Dogliotti | 446/71 |
| 4,568,299 | 2/1986 | Montgomery | 446/160 |

FOREIGN PATENT DOCUMENTS

| | | | |
|---|---|---|---|
| 304023 | 12/1932 | Italy | 446/160 |
| 413689 | 12/1966 | Switzerland | 446/71 |
| 442784 | 2/1936 | United Kingdom | 446/160 |
| 1371282 | 10/1974 | United Kingdom | 446/160 |

*Primary Examiner*—Victor N. Sakran

*Attorney, Agent, or Firm*—Stanley G. Ade; Adrian D. Battison

[57] ABSTRACT

The abstract and open-topped container includes a cover panel engagable within the open top acting as a closure. The panel also forms part of the hull of a boat which extends upwardly from the cover panel and is stored within the container when engaged therewith. When removed, it is reversed with the outer face of the cover panel becoming the underside of the boat with the boat extending upwardly therefrom. This can be used as a bath toy for children or, alternatively, in larger size, can consist of a camper unit with the boat being stored on the underside of the cover panel.

16 Claims, 4 Drawing Figures

STORAGE BOX FOR BOAT

BACKGROUND OF THE INVENTION

This invention relates to new and useful improvements in storage boxes or containers for boats and although it is designed primarily for use as a bath tub toy for children, nevertheless the structure is readily adapted for use as a boat storage and transporting device engageable within the open top of a rectangular utility trailer or the like.

Small children enjoy playing with toys in the bath tub and these toys often include many small articles made of plastic which are difficult to store when the bath tub is not in use.

The present device overcomes this disadvantage by providing a storage box which is readily detachably secured upon the outside vertical wall of the bath tub and includes a cover panel which can enclose the container.

A boat is formed on the underside of the cover panel which is normally stored within the container when the cover panel is in place. However when the cover panel is removed, it can be reversed and can then float in the bath tub with the hull and superstructure extending upwardly from the inner surface of the cover panel. A handle may be included spanning the superstructure which acts as a container for toys if the child wishes to transport the toys.

One aspect of the invention is to provide a device of character herewithin described which comprises a storage container and boat combination comprising an open-topped container and a cover therefore, said cover detachably engaging within the open upper end of the container, means cooperating between the cover panel and the walls of the container to receive and retain said cover in position, said cover forming part of the hull of a boat depending from the underside of said cover and into said container when said cover is engaged within the open upper end of the container.

Another advantage of the invention is to provide a device which although designed primarily for use as a bath tub toy, nevertheless can be manufactured in a larger scale and act as the cover and boat storage facility for use with a utility or camping trailer.

A still further advantage of the invention is to provide a device of the character herewithin described which is simple in construction, economical in manufacture and otherwise well suited to the purpose of which it is designed.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 1:
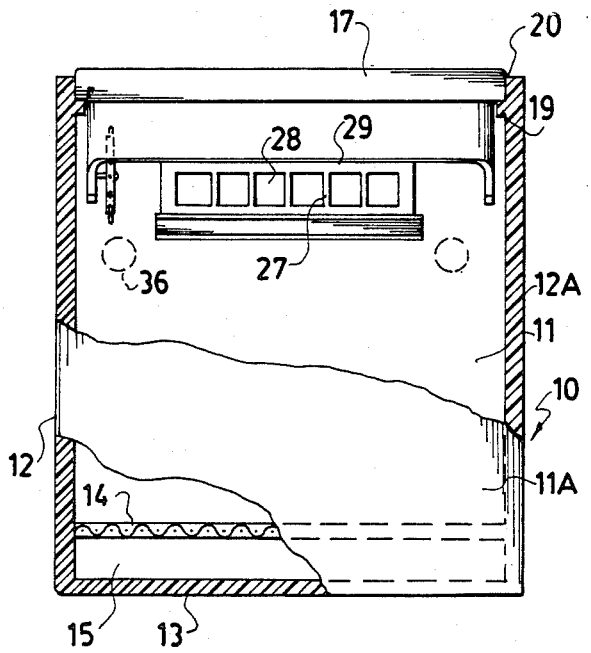
FIG. 1 is a vertical longitudinal section of the device with the cover panel in place.
Figure 2:
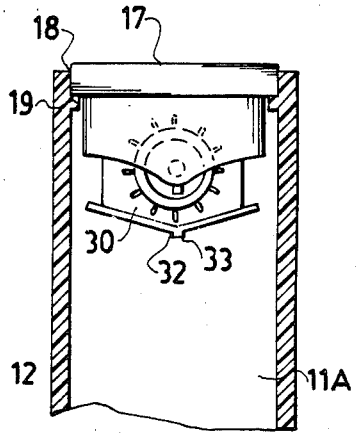
FIG. 2 is an end view of FIG. 1.
Figure 3:
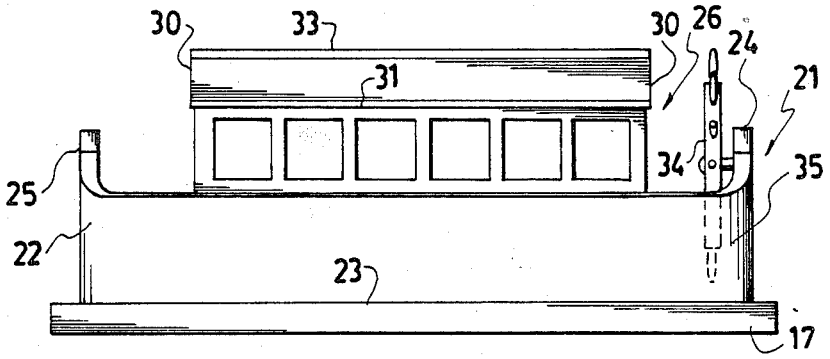
FIG. 3 is a side elevation of the cover panel and boat combination in the floating mode.
Figure 4:
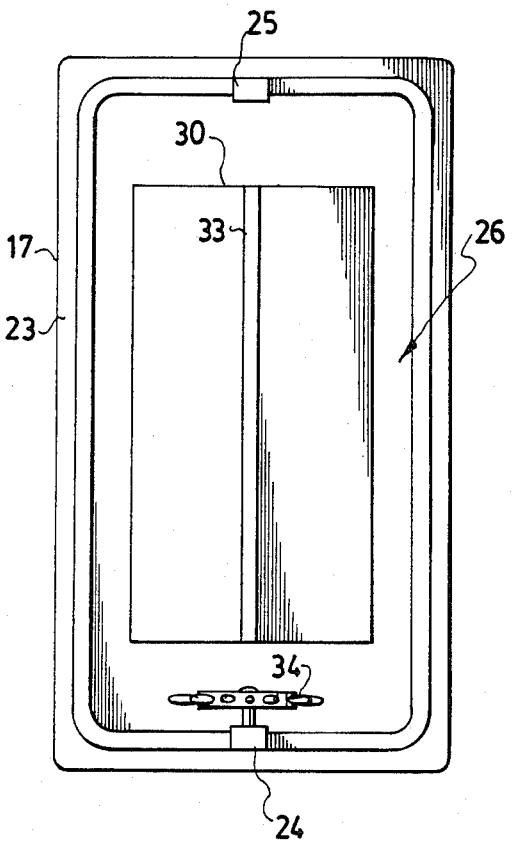
FIG. 4 is a plan view of a lower panel with the boat uppermost.

Proceeding therefore to describe the invention in detail, reference character 10 illustrates generally, a container which is rectangular when viewed in cross section and includes a pair of spaced and parallel substantially rectangular side panels 11 and 11A and a pair of substantially rectangular spaced and parallel end panels 12 and 12A secured together to form the rectangular configuration and having a planar base 13 spanning the lower ends of these side and end panels and being secured thereto.

Spaced upwardly from the base 13 and parallel therewith, is a drainage panel 14 made of plastic mesh or the like so that toys or other articles placed within the container and resting upon the drainage panel, can drain into the drainage area 15 between the panel 14 of the base 13.

A cover panel and boat combination collectively designated 16 is provided and consists of a rectangular cover panel 17 made from a floatation type material such as wood or rigid foam plastic and having a configuration substantially similar to the inside dimensions of the container 10 so that this panel will engage within the open upper end 18 of the container.

Means are provided to receive the panel within the open upper end and consists of a shoulder 19 extending around the inner walls of the side and end panels spaced below and parallel to the upper edges 20 thereof. This shoulder may be formed integrally with the side and end panel or may be formed from strips secured to the inner walls of the side and end panels by adhesive or the like.

The cover panel 17 forms part of the hull of the boat collectively designated 21 which consists of surrounding walls 22 extending upwardly from the undersurface 23 of the cover panel 17 and may have a profile which increases upwardly at the front and rear ends along the longitudinal axis of the boat to form a prow 24 and a stern 25.

Superstructure collectively designated 26 also extends upwardly from the inner surface 23 of the cover panel and within the sides 22 to define an enclosure 27 having a plurality of rectangular openings 28 formed therearound spaced below the upper perimeter 29 of the superstructure.

The end walls 30 of the superstructure may extend above the upper edges 31 of the side walls and the upper edges of these end walls may incline inwardly and upwardly to a common apex 32 having a longitudinally extending bar 33 extending therebetween and acting as a carrying handle.

A simulated spoked steering wheel 34 may engage a front standard 35 extending upwardly from adjacent the prow 24.

In use, means are provided to detachably secure the container to the side wall panel of a bath or the like (not illustrated), said means taking the form of a pair of suction cups 36 secured to one side panel or, alternatively, hooks may be provided extending upwardly and over from the side panel and hooking over the upper edge of the bath tub.

The cover is easily removed from the container, reversed, and may be floated within the bath tub. Alternatively, small toys (not illustrated) may be placed within the enclosure 27 defined by the superstructure 26 and carried from one place to another by the carrying handle 33.

The wet toys may be stored within the container upon the drainage panel 14 so that they may drain into the space 15 and the cover may be reversed and engaged within the upper open end of the container as hereinbefore described. Under these circumstances, the boat structure portion of the cover panel is suspended within the container from the downwardly facing side of the cover panel 17.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A storage container and boat combination comprising an open-topped container and a cover therefore, said cover detachably engaging within the open upper end of the container, means cooperating between the cover panel and the walls of the container to receive and retain said cover in position, said cover forming part of the hull of a boat depending from the underside of said cover and into said container when said cover is engaged within the open upper end of the container.

2. The device according to claim 1 in which said means cooperating between the cover panel and the walls of said container include perimetrical strips extending inwardly from the inside surfaces of the walls of said container spaced downwardly from and parallel with the upper edges of said walls and constituting a shoulder, said closure panel engaging within said upper end of the container and registering upon said shoulder.

3. The device according to claim 1 in which said boat includes a substantially planar deck, perimetrically surrounding walls around said deck and extending upwardly therefrom, superstructure extending upwardly from said deck defining an enclosure and a member extending longitudinally between the ends of said superstructure acting as a carrying handle.

4. The device according to claim 2 in which said boat includes a substantially planar deck, superstructure extending upwardly therefrom defining an enclosure and a member extending between the ends of said superstructure acting as a carrying handle.

5. The device according to claim 1 in which said container is substantially rectangular when viewed in plan and includes a pair of spaced and parallel side walls and a pair of spaced and parallel end walls and a base spanning the lower ends of said walls, and means to detactably secure said container in a substantially vertical position upon a substantially vertical surface, said means to detachably secure said container comprising a plurality of suction cups on one side wall side of said container operatively connecting same to said vertical surface.

6. The device according to claim 2 in which said container is substantially rectangular when viewed in plan and includes a pair of spaced and parallel side walls and a pair of spaced and parallel end walls and a base spanning the lower ends of said walls, and means to detactably secure said container in a substantially vertical position upon a substantially vertical surface, said means to detachably secure said container comprising a plurality of suction cups on one side wall side of said container operatively connecting same to said vertical surface.

7. The device according to claim 3 in which said container is substantially rectangular when viewed in plan and includes a pair of spaced and parallel side walls and a pair of spaced and parallel end walls and a base spanning the lower ends of said walls, and means to detactably secure said container in a substantially vertical position upon a substantially vertical surface, said means to detachably secure said container comprising a plurality of suction cups on one side wall side of said container operatively connecting same to said vertical surface.

8. The device according to claim 4 in which said container is substantially rectangular when viewed in plan and includes a pair of spaced and parallel side walls and a pair of spaced and parallel end walls and a base spanning the lower ends of said walls, and means to detactably secure said container in a substantially vertical position upon a substantially vertical surface, said means to detachably secure said container comprising a plurality of suction cups on one side wall side of said container operatively connecting same to said vertical surface.

9. The device according to claim 1 which includes a drainage panel spanning said container spaced upwardly from the lower ends thereof and situated spaced and parallel to the base of said container.

10. The device according to claim 2 which includes a drainage panel spanning said container spaced upwardly from the lower ends thereof and situated spaced and parallel to the base of said container.

11. The device according to claim 3 which includes a drainage panel spanning said container spaced upwardly from the lower ends thereof and situated spaced and parallel to the base of said container.

12. The device according to claim 4 which includes a drainage panel spanning said container spaced upwardly from the lower ends thereof and situated spaced and parallel to the base of said container.

13. The device according to claim 5 which includes a drainage panel spanning said container spaced upwardly from the lower ends thereof and situated spaced and parallel to the base of said container.

14. The device according to claim 6 which includes a drainage panel spanning said container spaced upwardly from the lower ends thereof and situated spaced and parallel to the base of said container.

15. The device according to claim 7 which includes a drainage panel spanning said container spaced upwardly from the lower ends thereof and situated spaced and parallel to the base of said container.

16. The device according to claim 8 which includes a drainage panel spanning said container spaced upwardly from the lower ends thereof and situated spaced and parallel to the base of said container.

* * * * *